US009181506B2

(12) United States Patent
Lotero et al.

(10) Patent No.: US 9,181,506 B2
(45) Date of Patent: Nov. 10, 2015

(54) SYNTHESIS OF DIESEL FUEL BLENDSTOCK FROM CARBOHYDRATES

(71) Applicant: PHILLIPS 66 COMPANY, Houston, TX (US)

(72) Inventors: Edgar Lotero, Cleveland, OK (US); Kristi A. Fjare, Ponca City, OK (US); Cory B. Phillips, Bartlesville, OK (US); Alexandru Platon, Bartlesville, OK (US)

(73) Assignee: PHILLIPS 66 COMPANY, Houston, TX (US)

( * ) Notice: Subject to any disclaimer, the term of this patent is extended or adjusted under 35 U.S.C. 154(b) by 0 days.

(21) Appl. No.: 14/282,302

(22) Filed: May 20, 2014

(65) Prior Publication Data

US 2014/0350292 A1 Nov. 27, 2014

Related U.S. Application Data

(60) Provisional application No. 61/825,756, filed on May 21, 2013.

(51) Int. Cl.
*C07C 69/73* (2006.01)
*C10L 1/02* (2006.01)

(52) U.S. Cl.
CPC .. *C10L 1/02* (2013.01); *C10L 1/026* (2013.01)

(58) Field of Classification Search
CPC ..... C07C 69/73
USPC ..... 560/179
See application file for complete search history.

(56) References Cited

U.S. PATENT DOCUMENTS

2005/0210738 A1* 9/2005 Manzer ..... 44/385

OTHER PUBLICATIONS

Fernandes et al, Applied Catalysis A (2012).*
Nandiwale et al,Applied Catalysis A (2013).*
Harwardt et al, Separation Science and Engineering (2011).*

* cited by examiner

*Primary Examiner* — Kamal Saeed
*Assistant Examiner* — Janet L Coppins
(74) *Attorney, Agent, or Firm* — Phillips 66 Company

(57) ABSTRACT

Carbohydrates as derived from plant biomass can be converted into mono-alcohols, diols, and/or bi-functional alcohols or into carboxylic acid derivatives. By catalytic transesterification of such carbohydrate derivatives, ester-type diesel-fuel blendstock components may be produced. More specifically, alkyl levulinates are catalytically trans-esterified with hydroxyl-functionalized compounds where both the alcohols and the alkyl levulinates are derived from biomass carbohydrates. Esters produced in this way show physicochemical characteristics that make them suitable for use as diesel fuel blendstock.

9 Claims, 2 Drawing Sheets

SYNTHESIS OF DIESEL FUEL BLENDSTOCK FROM CARBOHYDRATES

CROSS-REFERENCE TO RELATED APPLICATIONS

This application is a Non-Provisional Application which claims the benefit of and priority to U.S. Provisional Application Ser. No. 61/825,756 filed May 21, 2013, entitled "Synthesis of Diesel Fuel Blendstock from Carbohydrates," which is hereby incorporated by reference.

STATEMENT REGARDING FEDERALLY SPONSORED RESEARCH OR DEVELOPMENT

None.

FIELD OF THE INVENTION

This invention relates to making diesel fuel blendstock from biomass and more precisely to making materials from biomass that may be blended with diesel fuel and used in conventional diesel fuel engines.

BACKGROUND OF THE INVENTION

There is an increasing interest to derive compounds from biomass that may be used as fuel components in gasoline, jet fuel, or diesel fuels. For instance, ethanol is currently produced at large scale as a fuel component for gasoline. Ethanol is presently allowed to be blended into gasoline at a maximum of ten percent of the volume of the resulting gasoline fuel. Higher concentrations of ethanol are likely to cause corrosion issues for vehicles that were not designed for high ethanol fuels such as E85 (eighty-five percent ethanol and fifteen percent hydrocarbon based gasoline). Most gasoline fuel sold in the US includes ethanol.

Biodiesel, as obtained from the transesterification of vegetable oils and animal fats, is a common blending component of diesel fuel and may legally and technically be added is high proportions. However, only low concentration blends of biodiesel-in-diesel are currently used due in part to the limited availability of biodiesel feedstocks. Renewable diesel is another biofuel that can be blended with diesel in high concentrations and is made from vegetable oils and animal fats. Renewable diesel faces the same limitations as biodiesel in terms of feedstock availability.

It is highly desirable to use lignocellulosic biomass (the most abundant form of biomass on the planet) as a source of fuel components for diesel. However, little success has been achieved in transforming lignocellulose components, i.e. lignin and carbohydrates for the most part, into compounds that can be used in blends with diesel. This lack of success is due in part to the nature of lignocellulose fractions. Lignin, for instance, makes for about 5-30% of plant biomass (lignocellulose). Lignin is a tri-dimensional, highly branched aromatic polymer with mainly ether-type linkages whose aromatic functions are single phenyl rings. Lignin is particularly difficult to process into compounds that could be used as transportation fuel components and, thus far, there is no commercial technology that converts lignin into fuel components. The other lignocellulose fraction, the carbohydrate fraction (70-95%), is mainly composed of cellulose and hemicellulose. These carbohydrates are biopolymers whose polymeric units are single sugars with five to six carbon atoms. Such sugar units are joined through glycosidic bonds, i.e., C—O—C bonds. When carbohydrates are thermally or biochemically processed for fuel applications, the products are oxygenates or hydrocarbons with two to six carbon atoms. These types of compounds (e.g. ethanol, butanol, pentane, hexane, and others) are suitable for gasoline blending, but they do not fulfill specifications for diesel blending. Thus, there is an opportunity for technologies that are able to convert carbohydrates (cellulose and hemicellulose, and corn starch and sugar cane carbohydrates) into compounds fungible with diesel fuel that meet diesel fuel characteristics.

BRIEF SUMMARY OF THE DISCLOSURE

The invention more particularly relates to a process for converting lignocellulosic carbohydrates to diesel fuel blendstock where a levulinate solution derived from lignocellulosic carbohydrates where the levulinate solution comprises levulinate molecules is provided with an alcohol solution comprising alcohol molecules wherein the alcohol molecules include one or more hydroxyl groups. The levulinate solution and the alcohol solution are transesterified over a transesterification catalyst under effective conditions to combine at least some of the levulinate molecules with some of the alcohol molecules to form larger molecules that are diesel range molecules suitable for diesel fuel blendstock.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

The present invention seeks to provide bio-sourced diesel fuels through the transesterification of products from biomass processing systems. Diesel fuel is a hydrocarbon based fuel typically separated from crude oil by fractional distillation between 200° C. and 350° C. Diesel fuel must meet a number of stringent specifications and blendstock for diesel generally conforms to the specifications. However, the specifications are measured for the blended fuel that is to be sold to consumers. So, while the pre-blended bio-sourced materials may not meet specifications, in general the closer the bio-sourced blendstock fits the specifications, the higher the proportion or percentage that the blendstock may comprise of the final fuel.

Figure 1:
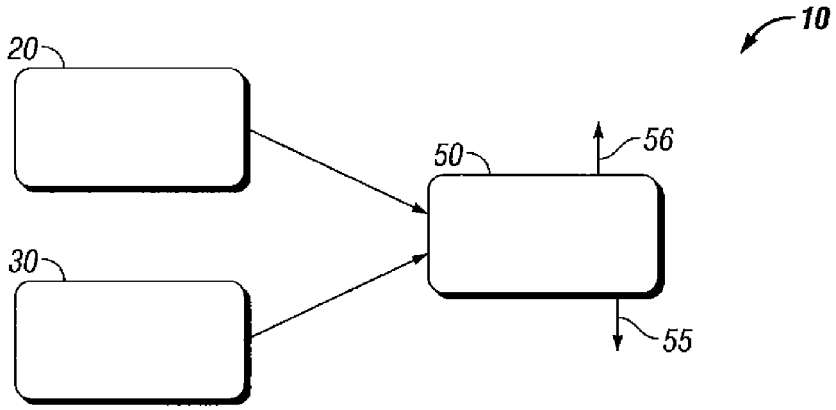
FIG. 1 is flow chart showing the basic process of the present invention.

Turning to FIG. 1, a bio-sourced diesel process is generally indicated by the numeral 10. The bio-sourced diesel process 10 includes a sub-process 20 for making cellulosic oxygenates from carbohydrates via strong acid catalysis. For example, tetrahydrofurfuryl alcohols and alkyl levulinates can be obtained from organic cellulosic materials via strong acid catalysis. In this process, materials such as wood chips and/or corn stover are made into a slurry with water/alcohol solution along with an acid, such as sulfuric acid, to break down the cellulosic material into furfural, formic acid and levulinates including alkyl levulinates.

Furfural and formic acid are separated as vapor products during processing and levulinate products are kept as liquid products together with other process byproducts. Alkyl levulinates can be separated from hydrolysis byproducts and the acid catalyst through solvent extraction using a medium-to-low polarity solvent (e.g., ethyl acetate). Alkyl levulinates are easily purified via low temperature distillation with solvent recycling.

Turning to sub-process 30, furfural can be hydrogenated into tetrahydrofurfuryl alcohol. The hydrogen is preferably bio-derived. Carbohydrate alcohols can also be formed through hydrogenolysis of starch sugars and/or sugar alcohols and/or cellulosic carbohydrates. Hydrogenolysis of sorbitol, for instance, produces a mixture of mono-alcohols and di-alcohols (or diols) and tri-alcohols (triols) that includes propanols, butanols, pentanols, hexanols, ethylene glycol, propylene glycol, 1,3-propanediol, butanediols, pentanediols, hexanediols, among other alcohols.

Transesterification of alkyl levulinates using carbohydrate derived alcohols, such as tetrahydrofurfuryl alcohol and/or diols/mono-alcohols obtained via hydrogenolysis, produces esters suitable as diesel fuel blendstock. Transesterification can be carried out under acid or base catalysis. Base catalysis is preferred over acid catalysis for kinetic reasons, but acid catalysis is suitable for the application when using feedstocks with high acid content.

Representative reactions in reactor 50 are shown in FIGS. 2, 3, 4 and 5. The alkoxy group in the alkyl levulinate (usually ethanol) can be captured and recycled through outlet 56 while the ester products leave reactor 50 through outlet 55.

Figure 2:
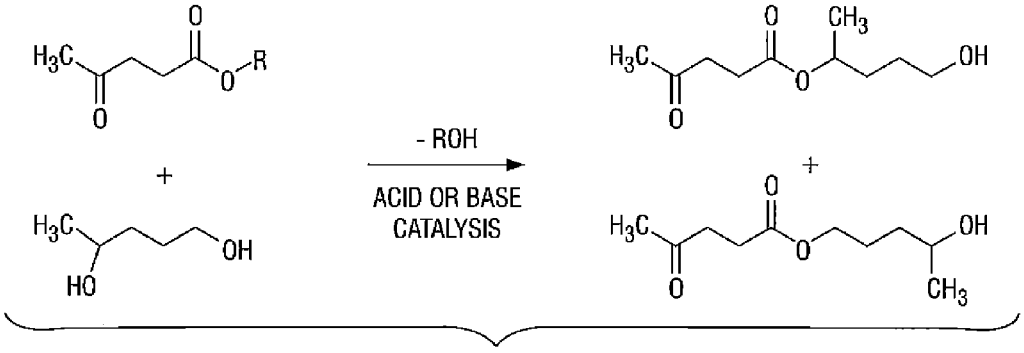
FIG. 2 is a diagram showing one type of chemical reaction to make products according to the present invention.

In FIG. 2, alkyl levulinate is combined with 1,4 pentanediol over a suitable catalyst at effective conditions to form an ester and alcohol is simultaneously separated as the reaction progresses. This catalyst may be acid or base.

Figure 3:
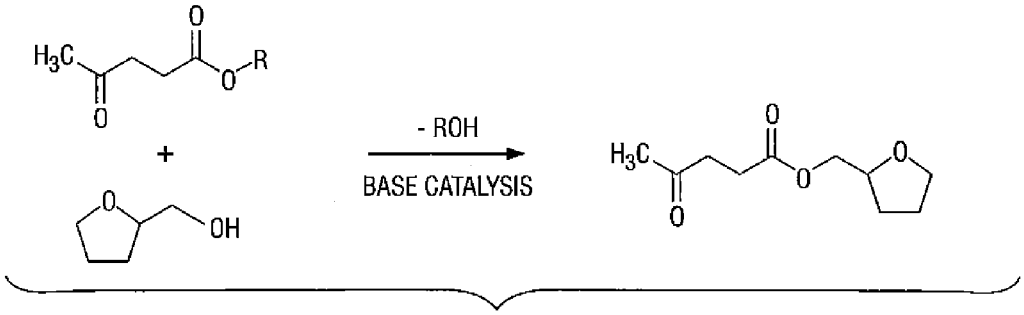
FIG. 3 is a diagram showing a second type of chemical reaction to make products according to the present invention.

In FIG. 3, alkyl levulinate is combined with tetrahydrofurfuryl alcohol over a suitable base catalyst at effective conditions to form an ester and alcohol is simultaneously separated as the reaction progresses.

Figure 4:
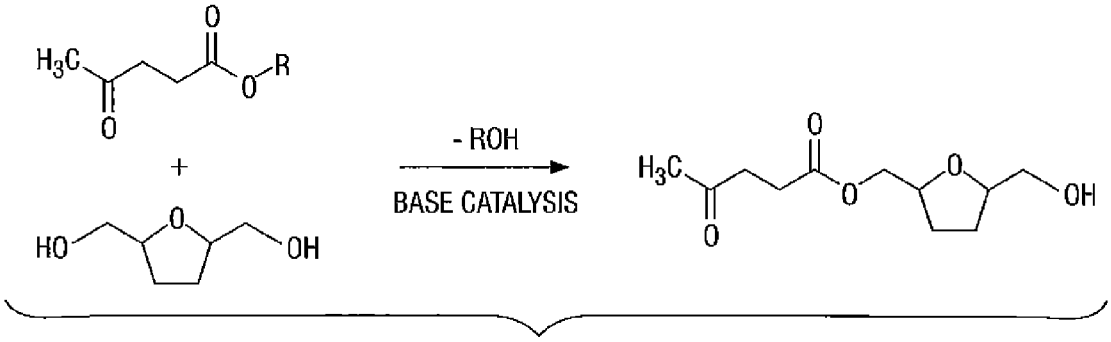
FIG. 4 is a diagram showing a third type of chemical reaction to make products according to the present invention.

In FIG. 4, alkyl levulinate is combined with tetrahydrofuran-2,5-dimethanol over a suitable base catalyst at effective conditions to form an ester and alcohol. The alcohol is simultaneously separated as the reaction progresses.

Figure 5:
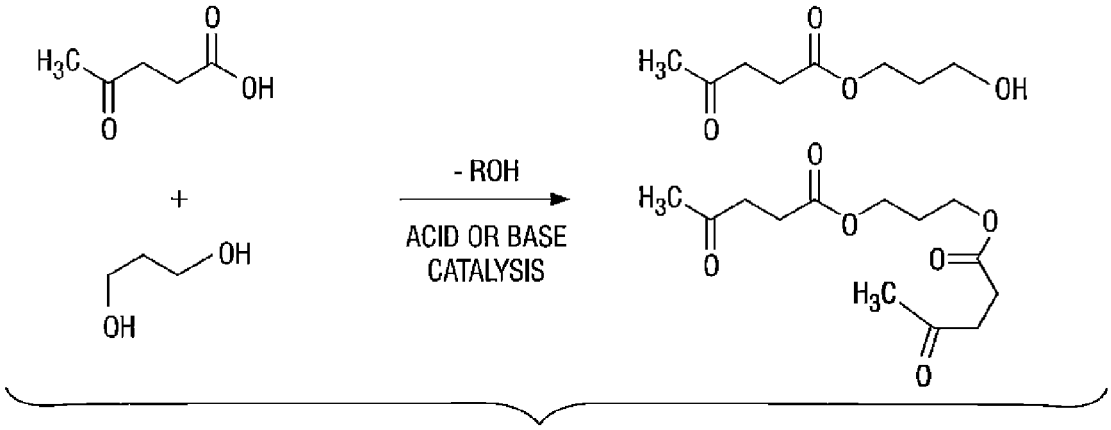
FIG. 5 is a diagram showing a fourth type of chemical reactions to make products according to the present invention.

In FIG. 5, alkyl levulinate is combined with 1,3-propanediol over a suitable base or acid catalyst at effective conditions to form an ester and alcohol. The alcohol is simultaneously separated as the reaction progresses.

These transesterification reactions are representative of many, many other similar reactions considering that both of the sub-processes 20 and 30 are known to produce many different chemicals. A non-exhaustive list of chemicals that may be produced in sub-process 20 includes alkyl levulinates, such as methyl levulinate, ethyl levulinate, propyl levulinate, and butyl levulinate, and levulinic acid. Sub-process 20 is also known to produce 5-hydroxymethyfurfural (HMF), 5-(chloromethyl) furfural, 2-(2-hydroxyacetyl)furan, and 5-(ethoxymethyl)furfural. Similarly, a non-exhaustive list of chemicals that may be produced in sub-process 30 includes tetrahydrofurfuryl alcohol, 5-hydroxymethytetrahydrofurfuran, methanol, ethanol, n-propanol, n-butanol, 2-butanol, isobutanol, n-pentanol, 2-pentanol, n-hexanol, 2-hexanol, 3-hexanol, ethylene glycol, propylene glycol, 1,3-propanediol, 1,2-butanediol, 1,4-butanediol, 1,5-pentanediol, 1,2-pentanediol, 1,6-hexanediol, 1,2-hexanediol, and 1,3-hexanediol Transesterification may be catalyzed by either bases or acids. Both homogeneous and heterogeneous catalysts catalyze the reactions. Heterogeneous catalysts are preferred as they minimize product separation operations and issues. But, homogeneous catalysts show better activity and are generally chosen from the standpoint of reaction kinetics. Other reaction schemes include reactions under supercritical conditions at high temperatures and pressures. Different reactor types and arrangements may be used for carrying out transesterification under both batch and continuous conditions.

Figure 6:
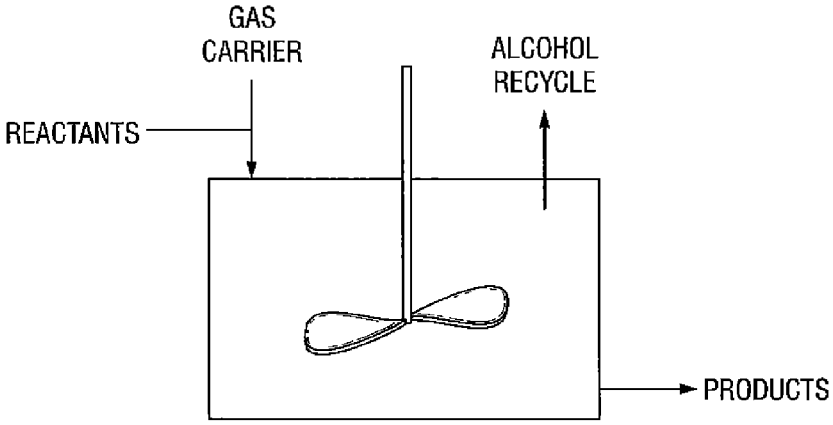
FIG. 6 is a diagram showing a reaction system for conducting the inventive process.

FIG. 6 illustrates a processing operation using a simplified continuous stirred tank reactor (CSTR) approach. Previous reaction products and reactants (and catalyst when using homogeneous catalysts) are combined or can be injected separately. The reactor contains the solid or in solution (homogeneous) acid or base catalyst and is maintained at 60-300° C., more preferable 80-to-180° C. and at atmospheric pressure up to 400 psig, but more preferably atmospheric. Reactant molar ratio can vary. The process can operate at excess molar ratio or either alcohol reactant or alky levulinate. In one embodiment an excess molar ratio of the alkyl levulinate is applied; the latter because at high conversions small concentrations of the alkyl ester reactant can be left as part of the product simplifying separation operations. Ethyl levulinate is a common alkyl ester reactant used in the proposed invention and is a possible blending component for diesel. Ethyl levulinate, however, has a very low cetane number and thus, only small concentrations of ethyl levulinate can be used for diesel blending. Processing, as proposed in this invention, recycles the alcohol component used during biomass acid hydrolysis, lowering cost. Furthermore, the alcohol is a byproduct of transesterification and is separated in-situ due to the large difference in the boiling point of the alcohol and other reaction components. The in-situ separation of the alcohol allows for better reaction thermodynamics favoring product formation during transesterification leading to high conversions. When using excess of the ester reactant, heavier molecular weight di-esters can be formed. Using molar excess of the alcohol reactant prevents the latter. When the alcohol reactant is used in excess, a distillation step is required to remove excess alcohol and other potential byproducts after reaction.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication data after the priority date of this application. Incorporated references are listed again here for convenience:

1. U.S. Pat. No. 6,376,701 B1, "Process for the transesterification of keto esters using solid acids as catalysts." Council of Scientific & Industrial Research; Priority Dec. 29, 1995.
2. U.S. Pat. No. 6,743,942 "Process for the transesterification of keto ester with alcohol using polyaniline salts as catalyst", Council of Scientific & Industrial Research; Priority Nov. 8, 2002.
3. U.S. Pat. No. 7,211,681, "Ester production method by transesterification reaction using solid acid catalyst", Japan Energy Corporation; Priority Mar. 26, 2003.
4. U.S. Pat. No. 7,265,239, "Process for the conversion of furfuryl alcohol into levulinic acid or alkyl levulinate", Shell Oil Company; Priority Aug. 26, 2005.
5. Montan, D., et al., High-temperature dilute-acid hydrolysis of olive stones for furfural production. Biomass and Bioenergy 2002. 22: p. 295-304.
6. Carrasco, F., Production of Furfural by Dilute-Acid Hydrolysis of Wood: Methods For Calculating Furfural Yield; Wood Fiber Sci., 1993. 25(1): p. 91-102.
7. Win, D. T., *Furfural—Goldfrom Garbage*. AU J. Technol 2005. 8(4): p. 185-190.
8. de Avila Rodrigues, F. and R. Guirardello, *Evaluation of a Sugarcane Bagasse Acid Hydrolysis Technology*. Chem.; Eng. Technol., 2008. 31(6): p. 883-892.
9. Karakhanov, E. A., et al., *Hydrogenation of furfural on polymer-containing catalysts* Chemistry of Heterocyclic Compounds, 1986: p. 243-246.
10. Wu, J., et al., Vapor phase hydrogenation of furfural to furfuryl alcohol over environmentally friendly Cu—Ca/SiO2 catalyst. Catal. Commun, 2005. 6: p. 633-637.
11. Merat, N, C. Godawa, and A. Gaset, High selective production of tetrahydrofurfuryl alcohol: Catalytic hydrogenation of Urfural and furfuryl alcohol. 1989. 48(2): p. 145-59.
12. Wojcik, B. H., *Catalytic Hydrogenation of Furan Compounds*. Ind. Eng. Chem, 1948. 40(2): p. 210-216.
13. Olson, E. S., *Conversion of lignocellulosic material to chemicals and fuels*. National Energy Technology Laboratory Pittsburgh, Pa., 2001. Energy & Environmental Research Center-University of North Dakota (http://www.osti.gov/energycitations/servlets/purl/786842-Nt9Wvz/native/786842.pdf): p. Technical Report.
14. Olson, E. S., et al., *Levulinate esters from biomass wastes*. ACS Symposium Series, 2001. 784(Chemicals and Materials from Renewable Resources): p. 51-63.
15. Van De Graaf W. D. and l-P. Lange, Process for the conversion of furfuryl alcohol into levulinic acid or alkyl levulinate. U.S. Pat. No. 7,265,239 2007. Shell Oil Company.
16. Lange, l-P.D., W. D. van de Graaf, and R. J. Haan, *Conversion of Furfuryl Alcohol into Ethyl Levulinate using Solid Acid Catalysts*. ChemSusChem, 2008. 2(5): p. 437-441.
17. Hsu, C. C. and D. W. Chasar, *Process for the manufacture of levulinic acid and esters*. U.S. Pat. No. 4,236,021 1980. The B. F. Goodrich Company.

The invention claimed is:

1. A process for converting lignocellulosic carbohydrates to diesel fuel blendstock comprising:

a) providing an alkyl levulinate solution derived from lignocellulosic carbohydrates where the alkyl levulinate solution comprises alkyl levulinate molecules;

b) providing an alcohol solution comprising alcohol molecules wherein the alcohol molecules include one or more hydroxyl groups, wherein the alcohol molecules are produced by hydrogenating other molecules that are co-produced from lignocellulosic carbohydrates along with the alkyl levulinate molecules of step a); and c) transesterifying the alkyl levulinate solution with the alcohol solution over a transesterification catalyst under effective conditions to react at least some of the alkyl levulinate molecules with some of the alcohol molecules to form larger alkyl levulinate molecules that are diesel range molecules suitable for diesel fuel blendstock.

2. The process for converting lignocellulosic carbohydrates to diesel fuel blendstock according to claim 1 further comprising using a homogeneous transesterification catalyst to transesterify at least some of the alkyl levulinate molecules with the alcohol molecules.

3. The process for converting lignocellulosic carbohydrates to diesel fuel blendstock according to claim 1 further comprising using a heterogeneous transesterification catalyst to transesterify at least some of the alkyl levulinate molecules with the alcohol molecules.

4. The process for converting lignocellulosic carbohydrates to diesel fuel blendstock according to claim 1 further comprising using an acid transesterification catalyst to transesterify at least some of the alkyl levulinate molecules with the alcohol molecules.

5. The process for converting lignocellulosic carbohydrates to diesel fuel blendstock according to claim 1 further comprising using an alkaline transesterification catalyst to transesterify at least some of the alkyl levulinate molecules with the alcohol molecules.

6. The process for converting lignocellulosic carbohydrates to diesel fuel blendstock according to claim 1 further comprising separating the diesel range fuel blendstock from lighter molecular weight materials following step (c).

7. The process for converting lignocellulosic carbohydrates to diesel fuel blendstock according to claim 1, wherein the alcohol molecules are produced by hydrogenating furfural to tetrahydrofurfuryl alcohol.

8. The process for converting lignocellulosic carbohydrates to diesel fuel blendstock according to claim 1 wherein the alcohol solution is produced by hydrogenolysis of starch or sugar alcohols derived from starch.

9. The process for converting lignocellulosic carbohydrates to diesel fuel blendstock according to claim 1 wherein the alcohol solution is produced by hydrogenolysis of lignocellulose or sugar alcohols derived from lignocellulose.

* * * * *